US011856377B2

(12) United States Patent
Minich et al.

(10) Patent No.: US 11,856,377 B2
(45) **Date of Patent: *Dec. 26, 2023**

(54) ACTIVE NOISE REDUCTION AUDIO DEVICES AND SYSTEMS

(71) Applicant: Bose Corporation, Framingham, MA (US)

(72) Inventors: David R. Minich, Natick, MA (US); Emery M. Ku, Somerville, MA (US); Alexia Delhoume, Framingham, MA (US); Michelle Gelberger, Cambridge, MA (US)

(73) Assignee: Bose Corporation, Framingham, MA (US)

( * ) Notice: Subject to any disclaimer, the term of this patent is extended or adjusted under 35 U.S.C. 154(b) by 208 days.

This patent is subject to a terminal disclaimer.

(21) Appl. No.: 17/176,585

(22) Filed: Feb. 16, 2021

(65) Prior Publication Data

US 2021/0168503 A1 Jun. 3, 2021

Related U.S. Application Data

(63) Continuation of application No. 16/565,293, filed on Sep. 9, 2019, now Pat. No. 10,959,019.

(51) Int. Cl.

| | |
|---|---|
| ***H04R 3/04*** | (2006.01) |
| ***H04R 5/033*** | (2006.01) |
| ***H04R 5/04*** | (2006.01) |

(52) U.S. Cl.

CPC ..... *H04R 3/04* (2013.01); *H04R 5/033* (2013.01); *H04R 5/04* (2013.01); *G10K 2210/1081* (2013.01); *H04R 2460/01* (2013.01)

(58) Field of Classification Search

CPC ..... A61F 11/06; H04R 1/10; H04R 1/1016; H04R 3/04; H04R 5/033; H04R 5/04;

(Continued)

(56) References Cited

U.S. PATENT DOCUMENTS

| | | | |
|---|---|---|---|
| 8,208,650 | B2 | 6/2012 | Joho et al. |
| 8,238,567 | B2 | 8/2012 | Burge et al. |

(Continued)

FOREIGN PATENT DOCUMENTS

| | | | |
|---|---|---|---|
| JP | 07240989 | A | 9/1995 |
| JP | 2004236463 | A | 8/2004 |

(Continued)

OTHER PUBLICATIONS

International Search Report and the Written Opinion of the International Searching Authority, International Application No. PCT/US2020/049708, pp. 1-14, dated Dec. 17, 2020.

(Continued)

*Primary Examiner* — Xu Mei

(74) *Attorney, Agent, or Firm* — Bond, Schoeneck & King, PLLC

(57) ABSTRACT

A method and system directed to controlling Active Noise Reduction (ANR) audio devices with active noise reduction. The system sets one or more ANR parameters of a first and a second wearable audio device to a first ANR state; detects that the first wearable audio device is removed from a first ear of a user; and automatically adjusts the one or more ANR parameters of the second wearable audio device to a second ANR state when the first wearable audio device is removed from the ear of the user, wherein the second ANR state comprises a reduction in a level of ANR compared to the first ANR state.

20 Claims, 7 Drawing Sheets

(58) Field of Classification Search
CPC ..... H04R 2460/01; G10K 2210/1081; G10K 2210/3033
USPC ..... 381/71.1, 71.6, 72, 73, 123
See application file for complete search history.

(56) References Cited

U.S. PATENT DOCUMENTS

| | | | | |
|---|---|---|---|---|
| 8,238,570 | B2 | 8/2012 | Johnson, Jr. et al. | |
| 8,243,946 | B2 | 8/2012 | Burge et al. | |
| 8,699,719 | B2 | 4/2014 | Johnson, Jr. et al. | |
| 8,798,283 | B2 | 8/2014 | Gauger, Jr. et al. | |
| 8,824,695 | B2 | 9/2014 | Bakalos et al. | |
| 9,014,387 | B2 * | 4/2015 | Hendrix | G10K 11/17854 381/74 |
| 9,479,860 | B2 | 10/2016 | Kwatra et al. | |
| 9,486,823 | B2 | 11/2016 | Andersen et al. | |
| 9,743,170 | B2 | 8/2017 | Yamkovoy | |
| 9,838,812 | B1 | 12/2017 | Shetye et al. | |
| 9,860,626 | B2 | 1/2018 | Ergezer et al. | |
| 9,894,452 | B1 | 2/2018 | Termeulen et al. | |
| 9,922,636 | B2 | 3/2018 | Ku | |
| 9,924,255 | B2 | 3/2018 | Patel et al. | |
| 9,949,017 | B2 | 4/2018 | Rule et al. | |
| 10,045,111 | B1 | 8/2018 | Bonner et al. | |
| 10,080,092 | B2 | 9/2018 | Shetye et al. | |
| 10,096,313 | B1 | 10/2018 | terMeulen et al. | |
| 10,244,306 | B1 | 3/2019 | Ku et al. | |
| 10,638,214 | B1 * | 4/2020 | Delhoume | G06F 3/03547 |
| 10,959,019 | B1 * | 3/2021 | Minich | H04R 1/1041 |
| 11,043,201 | B2 * | 6/2021 | Ku | G10K 11/17833 |
| 2011/0116643 | A1 | 5/2011 | Tiscareno et al. | |
| 2018/0206022 | A1 | 7/2018 | Hsieh | |
| 2018/0249265 | A1 * | 8/2018 | Termeulen | H04R 25/453 |
| 2019/0045291 | A1 | 2/2019 | Kofman | |
| 2019/0052951 | A1 | 2/2019 | Kofman et al. | |

FOREIGN PATENT DOCUMENTS

| | | | |
|---|---|---|---|
| JP | 2015173369 | A | 10/2015 |
| JP | 2020508616 | A | 3/2020 |

OTHER PUBLICATIONS

Office Action, Japanese Patent Application No. 2022-515562, dated Mar. 31, 2023, pp. 1-55, with pp. 1-29 being a translation.

Decision to Grant a Patent, Japanese Patent Application No. 2022-515562, dated Jul. 14, 2023, pp. 1-5, with pp. 1-2 being a translation.

* cited by examiner

ACTIVE NOISE REDUCTION AUDIO DEVICES AND SYSTEMS

CROSS-REFERENCE TO RELATED APPLICATIONS

This application is a Continuation Application of and claims priority to U.S. patent application Ser. No. 16/565,293 filed Sep. 9, 2019, and titled "Active Noise Reduction Audio Devices and Systems," which application is herein incorporated by reference in its entirety.

BACKGROUND

The present disclosure generally relates to methods and systems directed to controlling audio devices, such as headphones, with active noise reduction.

SUMMARY

All examples and features mentioned below can be combined in any technically possible way.

Generally, in one aspect, a method of controlling an Active Noise Reduction (ANR) audio system is provided. The method comprises: generating one or more control signals, using a controller, to set one or more ANR parameters of a first and a second wearable audio device to a first ANR state; detecting at least one of: whether the first wearable audio device is engaged with or removed from a first ear of a user, using a first sensor of the first wearable audio device; or whether a second wearable audio device is engaged with or removed form a second ear of a user, using a second sensor of the second wearable audio device; and automatically adjusting the one or more ANR parameters of the first and/or second wearable audio device to a second ANR state when either the first wearable audio device or the second wearable audio device, or both, are removed from an ear of the user, wherein the second ANR state comprises a reduction in a level of ANR at least at some frequencies compared to the first ANR state.

In an aspect, the method further comprises: detecting whether the first wearable audio device is engaged with or removed from a first ear of the user using a first sensor of the first wearable audio device and detecting whether the second wearable audio device is engaged with or removed from a second ear of the user using a second sensor of the second wearable audio device; and automatically adjusting the one or more ANR parameters of the first and second wearable audio device to the first ANR state when both the first and second wearable audio device are detected to be engaged with an ear of the user.

In an aspect, the one or more ANR parameters relate to at least one of a feedback filter, a feedforward filter, and an audio equalization.

In an aspect, the one or more ANR parameters of the second ANR state comprise at least one of: default settings or user-set ANR settings that are input by the user.

In an aspect, the one or more ANR parameters of the first ANR state comprise at least one of: default settings, user-set ANR settings that are input by the user, or a last-used ANR settings.

In an aspect, in the second ANR state, the first and second wearable audio device can be utilized to perform at least one of the following: start an audio signal to be reproduced by the audio system; stop an audio signal from being reproduced by the audio system; pause the audio signal that was being reproduced by the audio system; answer a phone call; decline a phone call; accept a notification; dismiss a notification; and access a voice assistant.

In an aspect, the first and second wearable audio device are arranged to operate in a plurality of ANR states during which the one or more ANR parameters are adjusted using a user interface to increase or decrease noise reduction.

In an aspect, the first sensor of the first wearable audio device and the second sensor of the second wearable audio device comprise at least one of: a gyroscope, an accelerometer, an infrared sensor, a magnetometer, an acoustic sensor, a motion sensor, a piezoelectric sensor, a piezoresistive sensor, a capacitive sensor, and a magnetic field sensor.

Generally, in one aspect, a computer program product comprising a set of non-transitory computer readable instructions stored on a memory and executable by a processor to perform a method for controlling an Active Noise Reduction (ANR) audio system is provided. The set of non-transitory computer readable instructions are arranged to: generate one or more control signals, using a controller, to set one or more ANR parameters of a first and a second wearable audio device to a first ANR state; detect at least one of: whether the first wearable audio device is engaged with or removed from a first ear of a user, using a first sensor of the first wearable audio device; or whether a second wearable audio device is engaged with or removed form a second ear of a user, using a second sensor of the second wearable audio device; and automatically adjust the one or more ANR parameters of the first and/or second wearable audio device to a second ANR state when either the first wearable audio device or the second wearable audio device, or both, are removed from an ear of the user, wherein the second ANR state comprises a reduction in a level of ANR at least at some frequencies compared to the first ANR state.

In an aspect, the set of non-transitory computer readable instructions further arranged to: detect whether the first wearable audio device is engaged with or removed from a first ear of the user using a first sensor of the first wearable audio device and detect whether the second wearable audio device is engaged with or removed from a second ear of the user using a second sensor of the second wearable audio device; and automatically adjust the one or more ANR parameters of the first and second wearable audio device to the first ANR state when both the first and second wearable audio device are detected to be engaged with an ear of the user.

In an aspect, the one or more ANR parameters relate to at least one of a feedback filter, a feedforward filter, and an audio equalization.

In an aspect, the one or more ANR parameters of the second ANR state comprise at least one of: default settings or user-set ANR settings that are input by the user.

In an aspect, the first and second wearable audio device are arranged to operate in a plurality of ANR states during which the one or more ANR parameters are adjusted using a user interface to increase or decrease noise reduction.

Generally, in one aspect, an Active Noise Reduction (ANR) audio system comprising a first wearable audio device and a second wearable audio device is provided. The first wearable audio device comprises: a first sensor arranged to determine if the first wearable audio device is engaged with or removed from a first ear of a user. The second wearable audio device comprises: a second sensor arranged to determine if the second wearable audio device is engaged with or removed from a second ear of the user. The audio system comprises a controller arranged to: generate one or more control signals to set one or more ANR parameters of the first and the second wearable audio device to a first ANR state; detect at least one of: whether the first wearable audio device is engaged with or removed from a first ear of a user, using a first sensor of the first wearable audio device or whether a second wearable audio device is engaged with or removed form a second ear of a user, using a second sensor of the second wearable audio device; and automatically adjust the one or more ANR parameters of the first and/or second wearable audio device to a second ANR state when either the first wearable audio device or the second wearable audio device, or both, are removed from an ear of the user, wherein the second ANR state comprises a reduction in a level of ANR at least at some frequencies compared to the first ANR state.

In an aspect, the controller is further arranged to: detect whether the first wearable audio device is engaged with or removed from the first ear of the user using the first sensor of the first wearable audio device and detecting whether the second wearable audio device is engaged with or removed from the second ear of the user using the second sensor of the second wearable audio device; and automatically adjust the one or more ANR parameters of the first and second wearable audio device to the first ANR state when both the first and second wearable audio device are detected to be engaged with an ear of the user.

In an aspect, the first and second wearable audio device are arranged to operate in a plurality of ANR states during which the one or more ANR parameters are adjusted using a user interface to increase or decrease noise reduction.

In an aspect, the first wearable audio device further comprises a first user interface adapted to receive user input to increase or decrease noise reduction.

In an aspect, the first wearable audio device further comprises a first outer surface, the first outer surface comprising a first touch capacitive sensor.

In an aspect, the controller is arranged within, around, or proximate to the first wearable audio device or the second wearable audio device.

In an aspect, the first sensor of the first wearable audio device and the second sensor of the second wearable audio device comprise at least one of: a gyroscope, an accelerometer, an infrared sensor, a magnetometer, an acoustic sensor, a motion sensor, a piezoelectric sensor, a piezoresistive sensor, a capacitive sensor, and a magnetic field sensor.

These and other aspects of the various illustrations will be apparent from and elucidated with reference to the aspect(s) described hereinafter.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the various aspects.

DETAILED DESCRIPTION

Figure 1:
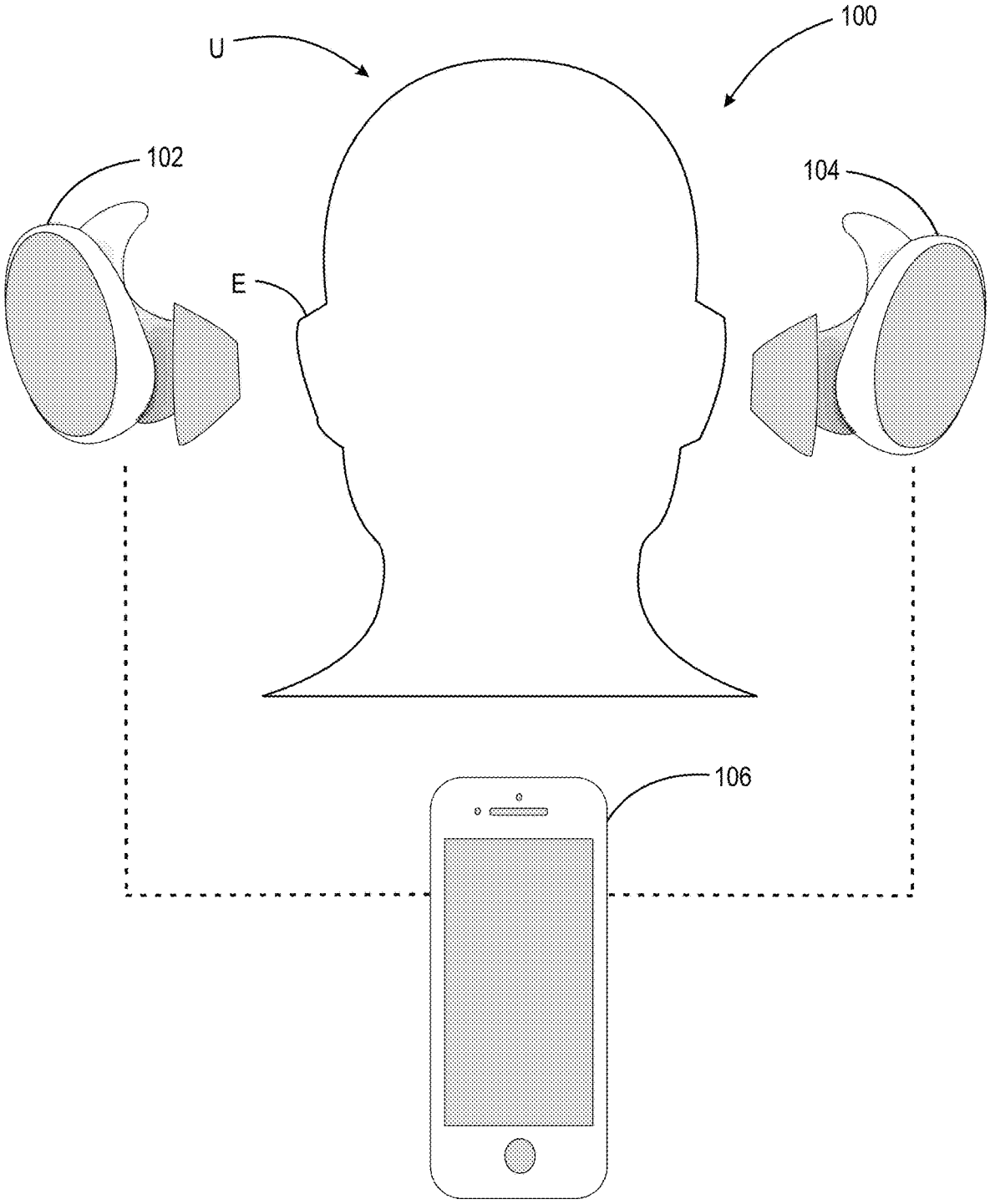
FIG. 1 illustrates an example of an audio system of the present disclosure.

In headphones, such as wireless headphones, that have Active Noise Reduction ("ANR") capability, different ANR settings may provide different levels of noise reduction. The present disclosure provides methods and systems directed to automatically adjusting the ANR parameters that alter noise reduction levels in the headphones based on whether the headphones are engaged with or removed from a user ear. According to an example, the system detects whether one or both of a first headphone and a second headphone are engaged with a user's ear. If both headphones are engaged with a user's ear, then the ANR subsystem automatically adjusts the ANR settings of the two headphones to bring the headphones to a first ANR state with either a default high level of noise reduction, a user-selected level of noise reduction, or the last selected level of noise reduction. If one or both headphones are removed from the ear, both headphones are brought to a second ANR state with lower levels of noise reduction. This enables a user to have lower noise reduction settings in a headphone engaged with the ear after removing the other headphone from the ear, to for example, have a conversation with someone. When both headphones are returned to the ear, the system automatically raises the noise reduction levels to those used in the first ANR state.

ANR subsystems are used for cancelling or reducing unwanted or unpleasant noise. An ANR subsystem can include an electroacoustic system that can be configured to cancel at least some of the unwanted noise (often referred to as primary noise) based on the principle of superposition. This can be done by identifying an amplitude and phase of the primary noise and producing another signal (often referred to as an anti-noise signal) of about equal amplitude and opposite phase. An appropriate anti-noise signal combines with the primary noise such that both are substantially canceled at the location of an error sensor (e.g., canceled to within a specification or acceptable tolerance). In this regard, in the example implementations described herein, "canceling" noise may include reducing the "canceled" noise to a specified level or to within an acceptable tolerance, and does not require complete cancellation of all noise. Noise canceling systems may include feedforward and/or feedback signal paths. A feedforward component detects noise external to the headset (e.g., via an external microphone) and acts to provide an anti-noise signal to counter the external noise expected to be transferred through to the user's ear. A feedback component detects acoustic signals reaching the user's ear (e.g., via an internal microphone) and processes the detected signals to counteract any signal components not intended to be part of the user's acoustic experience. Although described herein as coupled to, or placed in connection with, other systems, through wired or wireless means, it should be appreciated that noise cancelling systems may be independent of any other systems or equipment.

The term "wearable audio device" as used herein is intended to mean a device that fits around, on, in, or near an ear and that radiates acoustic energy into or towards the ear canal. Wearable audio devices are sometimes referred to as headphones, earphones, earpieces, headsets, earbuds or sport headphones, and can be wired or wireless. A wearable audio device includes an acoustic driver to transduce audio signals to acoustic energy. The acoustic driver may be housed in an earcup. While some of the figures and descriptions following may show a single wearable audio device, a wearable audio device may be a single stand-alone unit or one of a pair of wearable audio devices (each including a respective acoustic driver and earcup), one for each ear. A wearable audio device may be connected mechanically to another wearable audio device, for example by a headband and/or by leads that conduct audio signals to an acoustic driver in the wearable audio device. A wearable audio device may include components for wirelessly receiving audio signals. A wearable audio device may include components of an active noise reduction system. Wearable audio devices may also include other functionality such as a microphone so that they can function as a headset. While FIG. 1 shows an example of an around-ear headset, in other examples the headset may be an in-ear, on-ear, or near-ear headset. In some examples, a wearable audio device may be an open-ear device that includes an acoustic driver to radiate acoustic energy towards the ear canal while leaving the ear open to its environment and surroundings.

Referring now to the drawings, FIG. 1 schematically illustrates audio system 100. Audio system 100 generally includes first headphone 102, second headphone 104, and peripheral device 106. First headphone 102 and second headphone 104 are both arranged to communicate with peripheral device 106 and/or communicate with each other. Peripheral device 106 may be any device capable of establishing a connection with first headphone 102 and/or second headphone 104, either wirelessly through wireless protocols known in the art, or via a wired connection, i.e., via a cable capable of transmitting a data signal from peripheral device 106 to first headphone 102 or second headphone 104. In one example, first headphone 102 and second headphone 104 are in ear or on ear earbuds each arranged to communicate wirelessly with a peripheral device 106. In one example, peripheral device 106 is a smartphone having a computer executable application installed thereon such that the connection between peripheral device 106, first headphone 102 and/or second headphone 104 can be mutually established using a user interface on peripheral device 106.

Figure 2A:
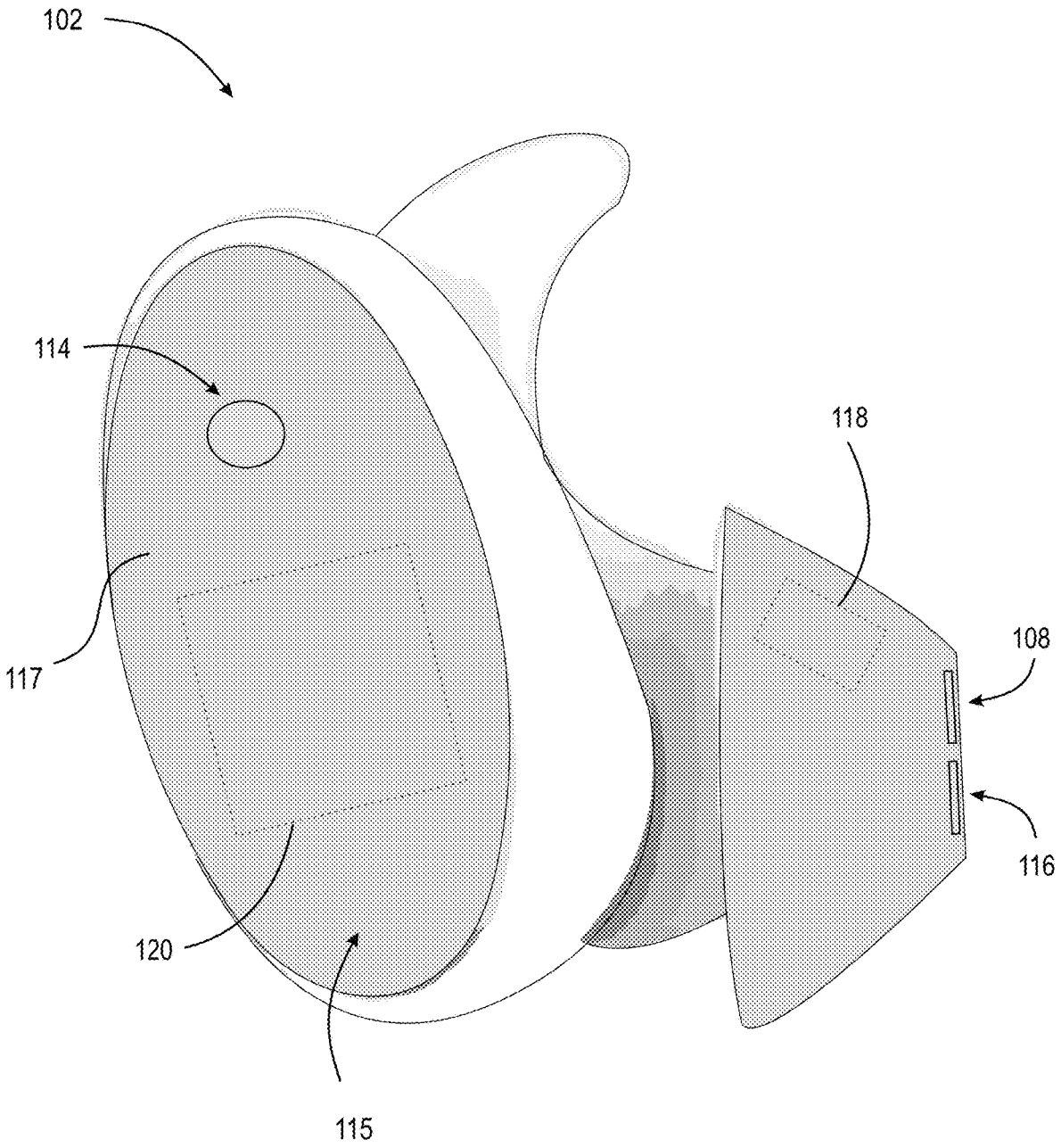
FIG. 2A illustrates a first headphone according to an example of the present disclosure.

FIG. 2A illustrates first headphone 102. First headphone 102 includes a housing, which further includes first driver 108, which is an acoustic transducer for conversion of, e.g., an electrical signal, into an audio signal that the user may hear, and (referring to FIG. 3A) first antenna 110. The first audio signal may correspond to data related to at least one digital audio file, which can be streamed over a wireless connection to peripheral device 106 or first headphone 102, stored in first memory 112 (discussed below), or stored in the memory of peripheral device 106. First antenna 110 is arranged to send and receive wireless communication information from, e.g., second headphone 104 or peripheral device 106. As an example, first headphone 102 and second headphone 104 are each capable of wireless communication with a peripheral device 106. First headphone 102 includes a controllable ANR subsystem. First headphone 102 includes one or more microphones, such as a first feedforward microphone 114 and/or a first feedback microphone 116. The first feedforward microphone 114 may be configured to sense acoustic signals external to the first headphone 102 when worn, e.g., to detect acoustic signals in the surrounding environment before they reach the user's ear. The feedback microphone 116 may be configured to sense acoustic signals internal to an acoustic volume formed with the user's ear when the first headphone 102 is worn, e.g., to detect the acoustic signals reaching the user's ear. In various examples, one or more drivers may be included in a headphone, and a headphone may in some cases include only a feedforward microphone or only a feedback microphone, or multiple feedforward and/or feedback microphones. Returning to FIG. 2A, the housing further includes first outer surface 115 having a sensor arranged thereon. In one example, the sensor on first outer surface 115 of first headphone 102 is a touch capacitive sensor, e.g., first touch capacitive sensor 117. First touch capacitive sensor 117 is arranged to receive at least one user input corresponding to at least one first user control setting 119 of first set of user control settings 128 discussed with reference to FIG. 3A. At least one user input can include a swipe gesture (e.g., movement across first touch capacitive sensor 117), a single-tap, a double-tap (tapping at least two times over a predetermined period of time), triple-tap (tapping at least three times over a predetermined period of time) or any other rhythmic cadence/interaction with first touch capacitive sensor 117. It should also be appreciated that at least one user input could be an input from a sensor such as a gyroscope or accelerometer, e.g., when user U removes first headphone 102 from ear E, the gyroscope or accelerometer may measure a specified rotation, acceleration, or movement, indicative of user U removing the first headphone 102 from ear E. Additionally, first headphone 102 may also include first sensor 118 in order to detect proximity to or engagement with ear E of user U. Although shown in FIG. 2A as being arranged on an ear tip of first headphone 103, first sensor 118 could alternatively be arranged on or within the housing of first headphone 102. First sensor 118 can be any of: a gyroscope, an accelerometer, a magnetometer, an infrared (IR) sensor, an acoustic sensor (e.g., a microphone or acoustic driver), a motion sensor, a piezoelectric sensor, a piezoresistive sensor, a capacitive sensor, a magnetic field sensor, or any other sensor known in the art capable of determining whether first headphone 102 is proximate to, engaged with, within, or removed from ear E of user U.

Figure 3A:
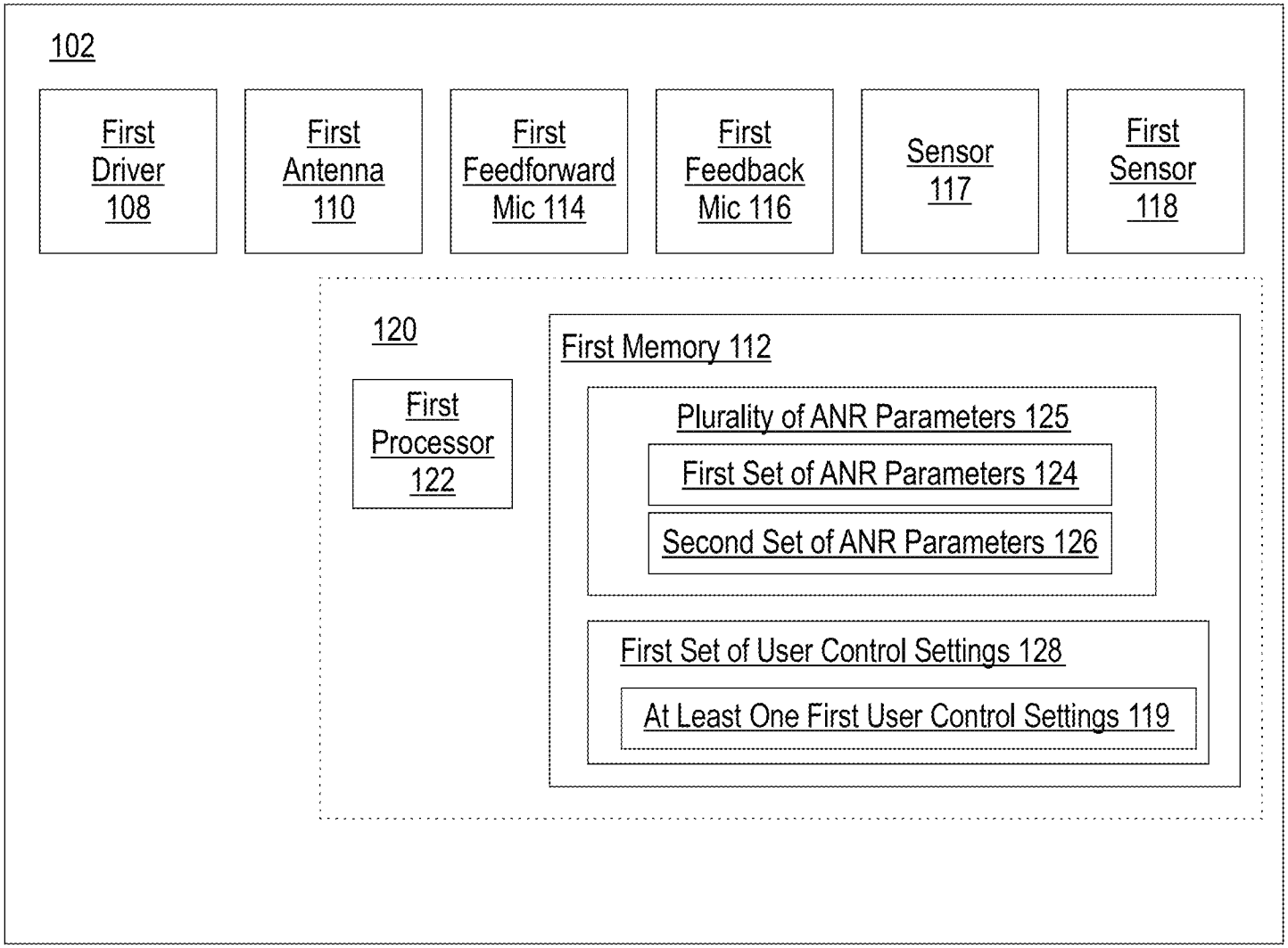
FIG. 3A schematically illustrates one example configuration of components included in a first headphone according to the present disclosure.

Referring to FIG. 3A, first headphone 102 further includes first controller 120. In an example, first controller 120 includes at least first processor 122 and first memory 112. The first processor 122 and first memory 112 of first controller 120 are arranged to receive, send, store, and execute any of a plurality of ANR parameters 125, a first set of ANR parameters 124, and/or a second set of ANR parameters 126 which may relate to a feedback filter, a feedforward filter, or audio equalization, based on a signal from the first feedforward microphone 114 and/or first feedback microphone 116. The first processor 122 and first memory 112 of first controller 120 are arranged to receive, send, store, and execute at least one first user control setting 119 of a first set of user control settings 128. In an example, first set of user control settings 128 can include settings such as, but not limited to: increase or decrease volume of the audio signal being reproduced by the audio system 100; increase or decrease noise reduction by an controller; start/play/stop/pause the audio signal being reproduced by the audio system 100; answer or decline a phone call; accept or dismiss a notification; and access a voice assistant, such as Alexa, Google Assistant, or Siri. The functions of the controller 120 may be performed by one or more separate controllers, which may be arranged to communicate with and operate in conjunction with each other. As an example, one controller may be arranged to receive, send, store, and execute any of a plurality of ANR parameters 125, a first set of ANR parameters 124, and/or a second set of ANR parameters 126, and a separate controller may be arranged to receive, send, store, and execute at least one first user control setting 119 of a first set of user control settings 128.

Figure 2B:
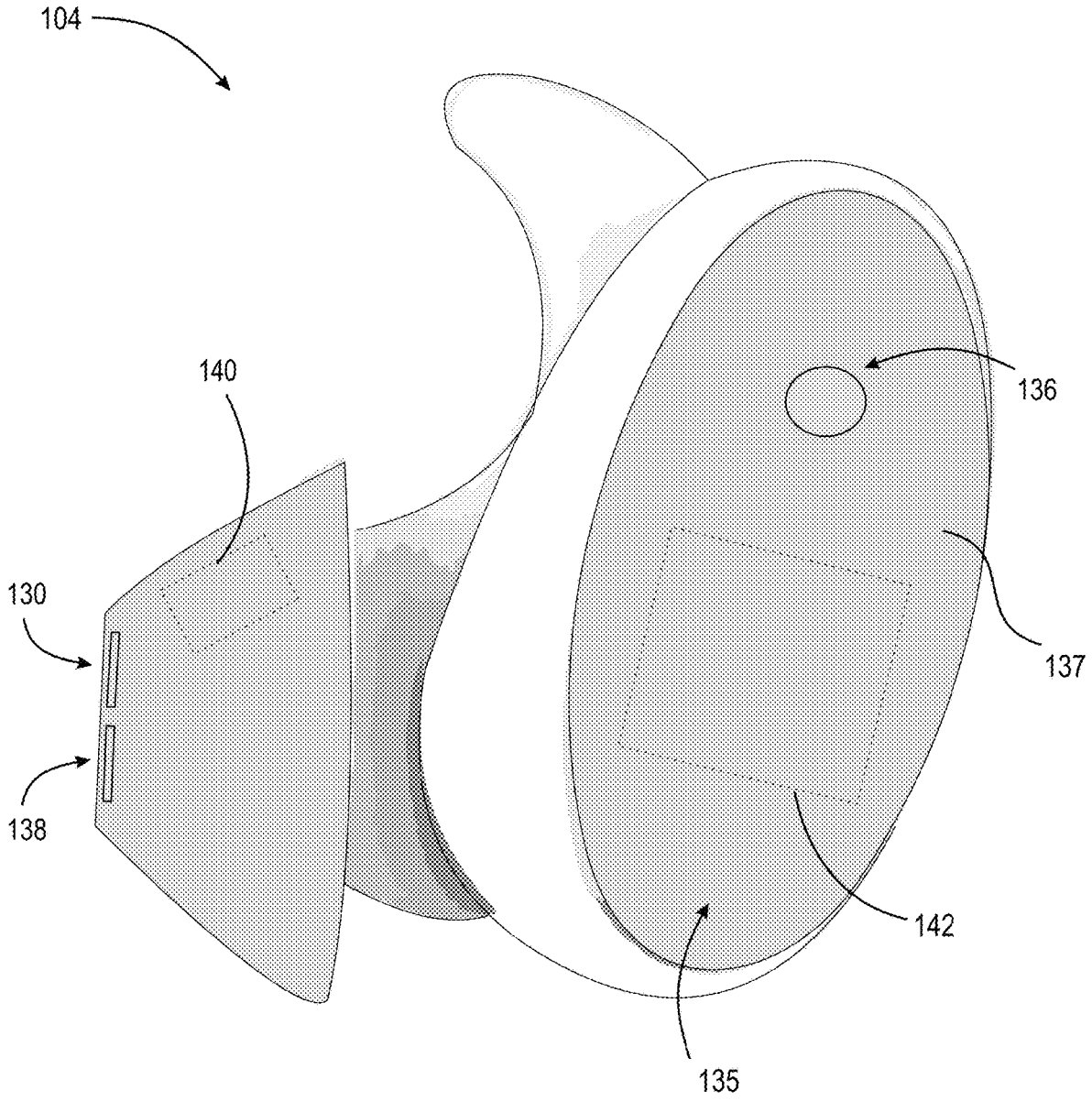
FIG. 2B illustrates a second headphone according to an example of the present disclosure.

FIG. 2B illustrates second headphone 104. Second headphone 104 also includes a housing, which further includes second driver 130 arranged to reproduce a second audio signal and (referring to FIG. 3B) second antenna 132. The second audio signal may correspond to data related to at least one digital audio file which can be streamed over a wireless connection to first headphone 102 or second headphone 104, stored in second memory 134 (discussed below), or stored in the memory of peripheral device 106. Second antenna 132 is arranged to send and receive wireless communication information from, e.g., first headphone 102 or peripheral device 106. As an example, first headphone 102 and second headphone 104 are each capable of wireless communication with a peripheral device 106. Second headphone 104 also includes a controllable ANR subsystem. Second headphone 104 includes one or more microphones, such as a second feedforward microphone 136 and/or a second feedback microphone 138. In various examples, one or more drivers may be included in a headphone, and a headphone may in some cases include only a feedforward microphone or only a feedback microphone, or multiple feedforward and/or feedback microphones. In one example, the sensor on second outer surface 135 of second headphone 104 is a touch capacitive sensor, e.g., second touch capacitive sensor 137. Second touch capacitive sensor 137 is arranged to receive at least one user input corresponding to at least one second user control setting 139 of second set of user control settings 146 discussed below. As discussed above with respect to first headphone 102, the at least one user input can include a swipe gesture (e.g., movement across second touch capacitive sensor 137), a single-tap, a double-tap (tapping at least two times over a predetermined period of time), triple-tap (tapping at least three times over a predetermined period of time) or any other rhythmic cadence/interaction with second touch capacitive sensor 137. It should also be appreciated that at least one user input could be an input from a sensor such as a gyroscope or accelerometer, e.g., when user U removes second headphone 104 from ear E, the gyroscope or accelerometer may measure a specified rotation, acceleration, or movement, indicative of user U removing the second headphone 104 from ear E. Additionally, second headphone 104 may also include second sensor 140 in order to detect proximity to or engagement with ear E of user U. Although shown in FIG. 2B as being arranged on an ear tip of second headphone 104, second sensor 140 could alternatively be arranged on or within the housing of second headphone 104. Second sensor 140 can be any of: a gyroscope, an accelerometer, a magnetometer, an infrared (IR) sensor, an acoustic sensor (e.g., a microphone or acoustic driver), a motion sensor, a piezoelectric sensor, a piezoresistive sensor, a capacitive sensor, a magnetic field sensor, or any other sensor known in the art capable of determining whether second headphone 104 is proximate to, engaged with, within, or removed from ear E of user U.

Figure 3B:
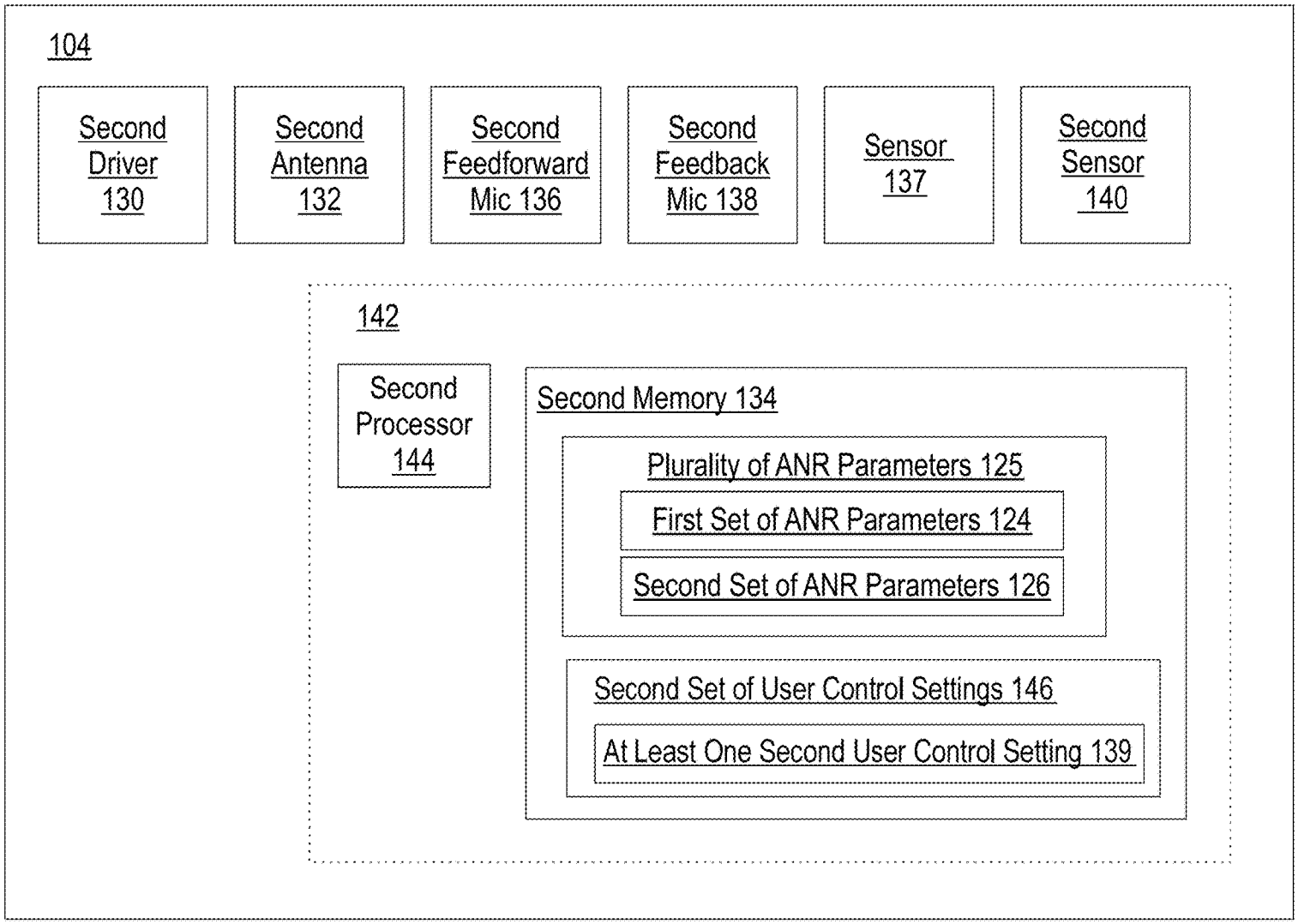
FIG. 3B schematically illustrates one example configuration of components included in a second headphone according to the present disclosure.

Referring to FIG. 3B, second headphone 104 further includes second controller 142. In an example, second controller 142 includes at least second processor 144 and second memory 134. The second processor 144 and second memory 134 of second controller 142 are arranged to receive, send, store, and execute any of a plurality of ANR parameters 125, a first set of ANR parameters 124, and/or a second set of ANR parameters 126 which may relate to a feedback filter, a feedforward filter, and an audio equalization, based on a signal from a second feedforward microphone 136 and/or second feedback microphone 138. The second processor 144 and second memory 134 of second controller 142 are also arranged to receive, send, store, and execute at least one second user 139 control setting of a second set of user control settings 146. The functions of the controller 142 may be performed by one or more separate controllers, which may be arranged to communicate with and operate in conjunction with each other. As an example, one controller may be arranged to receive, send, store, and execute any of a plurality of ANR parameters 125, a first set of ANR parameters 124, and/or a second set of ANR parameters 126, and a separate controller may be arranged to receive, send, store, and execute at least one second user control setting 139 of a second set of user control settings 146. As another example, only one of the first controller 124 or the second controller 142 may be present in both the first headphone 102 and the second headphone 104. In that case, the controller which is present in the first headphone or second headphone may detect whether one or both of the first headphone and the second headphone are engaged with or removed from the ear of a user and adjust ANR parameters in one or both headphones.

Figure 4:
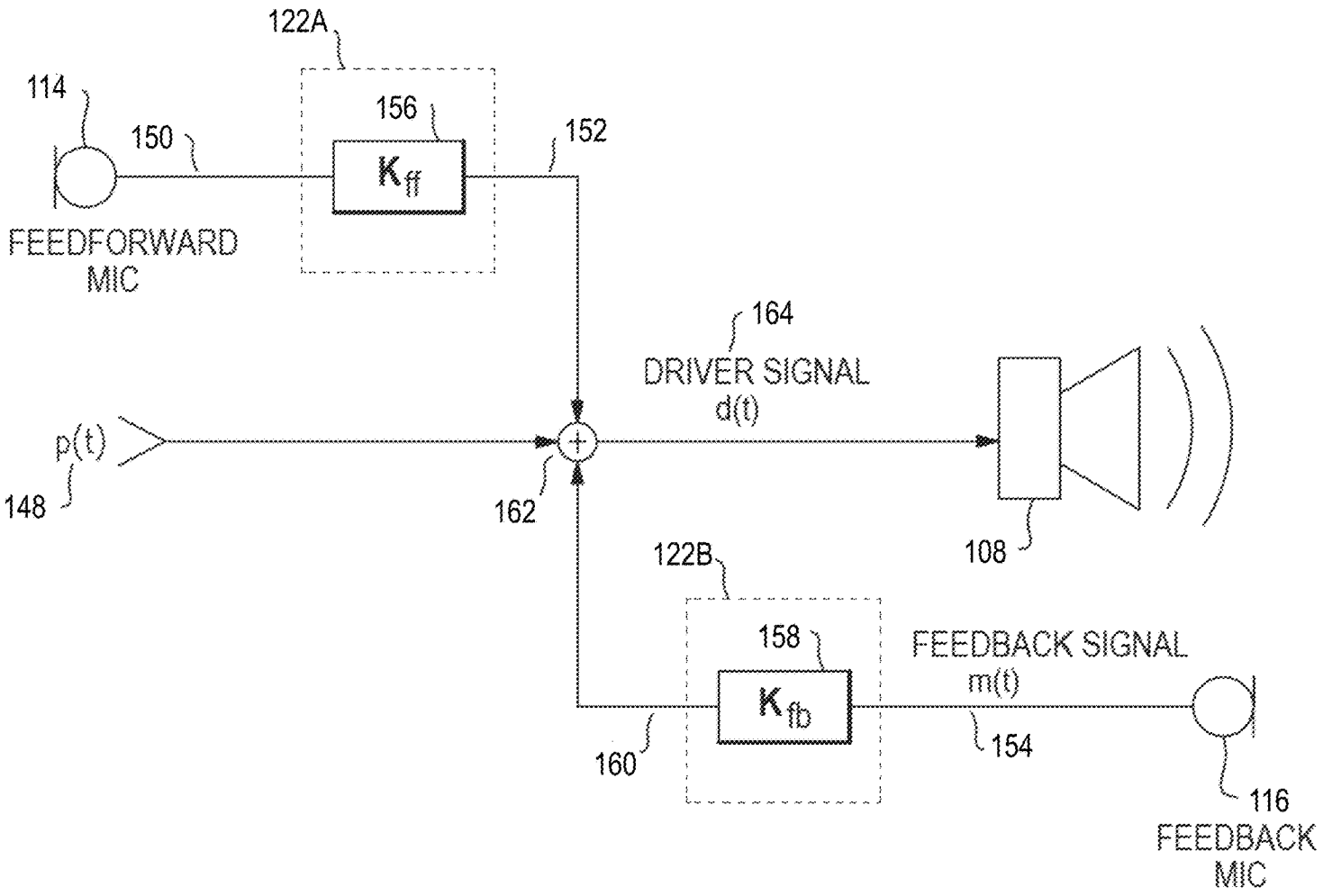
FIG. 4 is a schematic diagram of an exemplary active noise reduction system incorporating feedback and feedforward components.

FIG. 4 illustrates an exemplary system and method of processing microphone signals, for example in the first headphone 102, to reduce noise reaching the ear E of user U. FIG. 4 presents a simplified schematic diagram to highlight features of a noise reduction system. Various examples of a complete system may include amplifiers, analog-to-digital conversion (ADC), digital-to-analog conversion (DAC), equalization, sub-band separation and synthesis, and other signal processing or the like. In some examples, a playback signal 148, p(t), may be received to be rendered as an acoustic signal by the first driver 108. The first feedforward microphone 114 may provide a feedforward signal 150 that is processed by a feedforward processor 122A of the first processor 122, having a feedforward transfer function 156, Kff, to produce a feedforward anti-noise signal 152. The first feedback microphone 116 may provide a feedback signal 154 that is processed by a feedback processor 122B of the first processor 122, having a feedback transfer function 158, Kfb, to produce a feedback anti-noise signal 160. In various examples, any of the playback signal 148, the feedforward anti-noise signal 152, and/or the feedback anti-noise signal 160 may be combined, e.g., by a combiner 162, to generate a driver signal 164, d(t), to be provided to the first driver 108. In various examples, any of the playback signal 148, the feedforward anti-noise signal 152, and/or the feedback anti-noise signal 160 may be omitted and/or the components necessary to support any of these signals may not be included in a particular implementation of a system. Although the above example is provided on an ANR subsystem of the first headphone 102, the second headphone 104 is capable of providing noise cancellation and includes second controller 142, second processor 144, second feedforward microphone 136, and feedback microphone 138, and second driver 124 to perform noise reduction.

Different ANR settings providing different levels of noise reduction may be desirable to a user based on user preferences, system settings, and operational mode. For example, a user may desire more noise reduction based on environmental conditions and desire ANR settings that are more aggressive and cancel more noise and/or noise in a wider range of frequencies. Another user may desire less noise reduction, for example in order to hear more noise from the external environment, and desire less aggressive ANR settings that cancel less noise and/or noise in a narrower range of frequencies. To achieve different levels of noise reduction, different ANR parameters may be varied, for example, feedback filter settings, e.g., the gain and/or phase associated with a filter applied to a feedback microphone, e.g. first feedback microphone 116 or second feedback microphone 138, of the controllable ANR subsystem; feedforward filter settings, e.g., the gain and/or phase associated with a filter applied to a feedforward microphone, e.g. first feedforward microphone 114 or second feedforward microphone 136, of the ANR subsystem; audio equalization settings, and various other parameters of the noise reduction system, such as, for example, a driver signal amplitude (e.g., mute, reduce, or limit the driver signal 164).

During operation of audio system 100, first headphone 102 and/or second headphone 104 can pair (e.g. using known Bluetooth, Bluetooth Low Energy, or other wireless protocol pairing) or connect with peripheral device 106, e.g., a smartphone. An audio stream may be established between peripheral device 106, first headphone 102, and second headphone 104. The audio stream can include data relating to an audio file streamed over a wireless connection or a stored audio file. An ANR subsystem may be operational on the first headphone 102 and second headphone 104 having automatic ANR settings, which are set based on whether the headphones are engaged with or removed from a user's ear. The first sensor 118 and the second sensor 140 detect whether the first headphone 102 and the second headphone 104, respectively, are engaged with or removed from a user's ear. When both the first headphone 102 and the second headphone 104 are engaged with an ear of the user, the ANR settings of both headphones 102/104 are automatically adjusted to a first ANR state with a first set of ANR parameters, which may include one of: a default level of noise reduction, which may be a higher noise reduction setting to block unwanted noise from the environment; a user-selected level of noise reduction; or the last selected level of noise reduction. If a user removes one headphone 102/104 from the ear, the ANR settings are automatically adjusted by the first controller 120 and/or the second controller 142 to bring both headphones 102/104 to a second ANR state with a second set of ANR parameters, which may permit more of the environment to pass through the headphones 102/104. In this second ANR state, ANR may be lower than in the first ANR state at least at some frequencies, for example the frequencies that typically contain human speech sounds (e.g., 140 Hz to 5 kHz). Examples of technologies that can be used in the second ANR state to permit more of the environment to pass through the headphones 102/104 are described in U.S. Pat. Nos. 8,798,283; 9,949,017; and 10,096,313, each of which is incorporated herein by reference in its entirety. If the user has only removed the first headphone 102 from the ear, for example, to engage in a conversation with someone, the noise cancellation of the second headphone 104 is modified (as described above) to allow the conversation to be heard through the second headphone 104. In some examples, the noise cancellation of the first headphone 102 is also modified in the same manner. As another example, during the second ANR state, the headphones could take additional actions to make it easier for noise from the environment to be heard. For example, the volume on audio content may be reduced, audio content may be paused, audio content or phone conversation may be muted, or additional microphones on the headphone still engaged with a user's ear may be enabled which focus on environmental noise. When both headphones 102/104 are removed from the ears, the first controller 120 or second controller 142 also automatically adjusts the ANR parameters of both headphones 102/104 to bring both headphones 102/104 to the second ANR state. If a user then returns one or both headphones 102/104 to the ears, for example, after finishing a conversation, then the controller (either the first controller 120, the second controller 142, or both controllers) then automatically brings the headphones 102/104 to the first ANR state, which in some examples has greater noise reduction and can block more noise from the environment.

As an example, the ANR parameters of the first state and the second state may be default settings which are preprogrammed into the headphones 102/104, for example, during the manufacturing and assembly of the headphones. As another example, the ANR parameters may be adjustable so that a user can adjust the ANR parameters for the first ANR state and/or the second ANR state so that the level of noise reduction when the headphones operate in those states, for example, based on whether both headphones 102/104 are inserted in both ears, is adjusted. For example, a user may want less noise reduction when the headphones are operating in the second state, so that, as an example, the user can hear certain environmental noise like car horns or emergency vehicle sirens, or a desired amount of conversation through the headphone that is still in the user's ear. As another example, a user may desire less or more noise reduction in the first ANR state, for example, to be able to cancel unwanted environmental noise, e.g., airplane noise. The user may be able to adjust the ANR parameters of the first and/or second ANR state. As another example, the audio system 100 may be capable of operating in a plurality of ANR states, with a plurality of ANR parameters 125, where additional ANR states are available to a user in addition to the first ANR state and the second ANR state. These states may be preprograme into the audio system or adjustable by the user. As an example, the user may be able to increase or decrease noise reduction using a user interface, e.g., first touch capacitive sensor 117 and/or second touch capacitive sensor 137. Systems with multiple ANR states are described in the applications that have been incorporated by reference herein.

Figure 5:
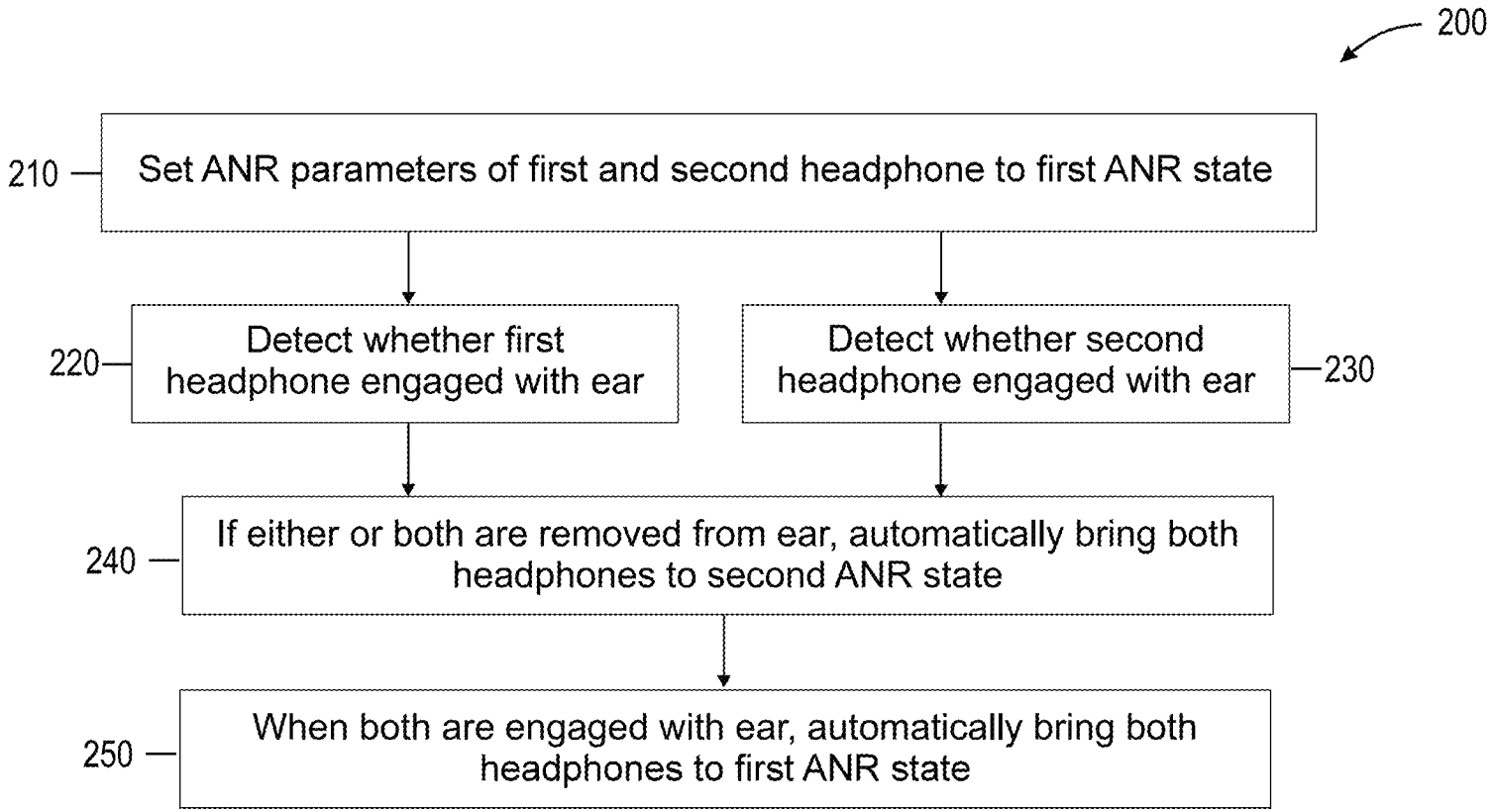
FIG. 5 is a flow-chart illustrating the steps of a method according to aspects of the present disclosure.

FIG. 5 is a flow-chart illustrating the steps of a method for controlling an audio system 100 according to aspects of the present disclosure. The method 200 includes the steps of: generating one or more control signals, using an Active Noise Reduction (ANR) controller 120/142, to set one or more ANR parameters of a first headphone 102 and a second headphone 104 to a first ANR state (step 210); detecting, at a first sensor 118 of the first headphone 102, whether the first headphone 102 is engaged with or removed from a first ear of a user (step 220); detecting, at a second sensor 140 of the second headphone 104, whether the second headphone 104 is engaged with or removed from a second ear of the user (step 230); automatically adjusting the one or more ANR parameters of the first headphone 102 and the second headphone 104 to a second ANR state when either the first headphone 102 or the second headphone 104, or both, are removed from an ear of the user, wherein the second ANR state comprises a reduction in a level of ANR at least at some frequencies compared to the first ANR state (step 240); automatically adjusting the one or more ANR parameters of the first headphone 102 and second headphone 104 to the first ANR state when both the first headphone 102 and second headphone 104 are detected to be engaged with an ear of the user (step 250).

A computer program product for performing a method for controlling an audio system 100 can have a set of non-transitory computer readable instructions. The set of non-transitory computer readable instructions can be stored and executed on a memory 112/134 and a processor 122/144 of a first headphone 102 and second headphone 104 (shown in FIGS. 2A and 2B). The set of non-transitory computer readable instructions can be arranged to: generate one or more control signals, using an Active Noise Reduction (ANR) controller 120/142, to set one or more ANR parameters of a first headphone 102 and a second headphone 104 to a first ANR state; detect, at a first sensor 118 of the first headphone 102, whether the first headphone 102 is engaged with or removed from a first ear of a user; detect, at a second sensor 140 of the second headphone 104, whether the second headphone 104 is engaged with or removed from a second ear of the user; automatically adjust the one or more ANR parameters of the first headphone 102 and the second headphone 104 to a second ANR state when either the first headphone 102 or the second headphone 104, or both, are removed from an ear of the user, wherein the second ANR state comprises a reduction in a level of ANR at least at some frequencies compared to the first ANR state; automatically adjust the one or more ANR parameters of the first headphone 102 and second headphone 104 to the first ANR state when both the first headphone 102 and second headphone 104 are detected to be engaged with an ear of the user.

The above-described examples of the described subject matter can be implemented in any of numerous ways. For example, some aspects may be implemented using hardware, software or a combination thereof. When any aspect is implemented at least in part in software, the software code can be executed on any suitable processor or collection of processors, whether provided in a single device or computer or distributed among multiple devices/computers.

The present disclosure may be implemented as a system, a method, and/or a computer program product at any possible technical detail level of integration. The computer program product may include a computer readable storage medium (or media) having computer readable program instructions thereon for causing a processor to carry out aspects of the present disclosure.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present disclosure may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some examples, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present disclosure.

Aspects of the present disclosure are described herein with reference to flowchart illustrations and/or block diagrams of methods, apparatus (systems), and computer program products according to examples of the disclosure. It will be understood that each block of the flowchart illustrations and/or block diagrams, and combinations of blocks in the flowchart illustrations and/or block diagrams, can be implemented by computer readable program instructions.

The computer readable program instructions may be provided to a processor of a, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various examples of the present disclosure. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

Other implementations are within the scope of the following claims and other claims to which the applicant may be entitled.

While various examples have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the examples described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific examples described herein. It is, therefore, to be understood that the foregoing examples are presented by way of example only and that, within the scope of the appended claims and equivalents thereto, examples may be practiced otherwise than as specifically described and claimed. Examples of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present disclosure.

The invention claimed is:

1. A method of controlling an Active Noise Reduction (ANR) audio system, comprising:

setting one or more ANR parameters of a first wearable audio device and a second wearable audio device to a first ANR state;

detecting that the first wearable audio device is removed from a first ear of a user; and automatically adjusting the one or more ANR parameters of the second wearable audio device to a second ANR state when the first wearable audio device is removed from the first ear of the user, wherein the second ANR state comprises a reduction in a level of ANR compared to the first ANR state.

2. The method of claim 1, further comprising:

detecting whether the first wearable audio device is engaged with or removed from the first ear of the user using a first sensor of the first wearable audio device and detecting whether the second wearable audio device is engaged with or removed from a second ear of the user using a second sensor of the second wearable audio device; and automatically adjusting the one or more ANR parameters of the first and second wearable audio device to the first ANR state when both the first and second wearable audio device are detected to be engaged with the first or second ears of the user.

3. The method of claim 1, wherein the one or more ANR parameters relate to at least one of a feedback filter, a feedforward filter, and an audio equalization.

4. The method of claim 1, wherein the one or more ANR parameters of the second ANR state comprise at least one of: default settings or user-set ANR settings that are input by the user.

5. The method of claim 1, wherein the one or more ANR parameters of the first ANR state comprise at least one of: default settings, user-set ANR settings that are input by the user, or a last-used ANR settings.

6. The method of claim 1, wherein in the second ANR state, the first and second wearable audio device can be utilized to perform at least one of the following: start an audio signal to be reproduced by the audio system; stop an audio signal from being reproduced by the audio system; pause the audio signal that was being reproduced by the audio system; answer a phone call; decline a phone call; accept a notification; dismiss a notification; and access a voice assistant.

7. The method of claim 1, wherein the first and second wearable audio device are arranged to operate in a plurality of ANR states during which the one or more ANR parameters are adjusted using a user interface to increase or decrease noise reduction.

8. The method of claim 1, wherein the first wearable audio device comprises a first sensor, the first sensor of the first wearable audio device and the second sensor of the second wearable audio device comprise at least one of: a gyroscope, an accelerometer, an infrared sensor, a magnetometer, an acoustic sensor, a motion sensor, a piezoelectric sensor, a piezoresistive sensor, a capacitive sensor, and a magnetic field sensor.

9. A computer program product comprising a set of non-transitory computer readable instructions stored on a memory and executable by a processor to perform a method for controlling an Active Noise Reduction (ANR) audio system, the set of non-transitory computer readable instructions arranged to:

set one or more ANR parameters of a first wearable audio device and a second wearable audio device to a first ANR state;

detect that the first wearable audio device is removed from a first ear of a user; and automatically adjust the one or more ANR parameters of the second wearable audio device to a second ANR state when the first wearable audio device is removed from the first ear of the user, wherein the second ANR state comprises a reduction in a level of ANR compared to the first ANR state.

10. The computer program product of claim 9, the set of non-transitory computer readable instructions further arranged to:

detect whether the first wearable audio device is engaged with or removed from the first ear of the user using a first sensor of the first wearable audio device and detect whether the second wearable audio device is engaged with or removed from a second ear of the user using a second sensor of the second wearable audio device; and automatically adjust the one or more ANR parameters of the first and second wearable audio device to the first ANR state when both the first and second wearable audio device are detected to be engaged with the first and second ears of the user.

11. The computer program product of claim 9, wherein the one or more ANR parameters relate to at least one of a feedback filter, a feedforward filter, and an audio equalization.

12. The computer program product of claim 9, wherein the one or more ANR parameters of the second ANR state comprise at least one of: default settings or user-set ANR settings that are input by the user.

13. The computer program product of claim 9, wherein the first and second wearable audio device are arranged to operate in a plurality of ANR states during which the one or more ANR parameters are adjusted using a user interface to increase or decrease noise reduction.

14. An Active Noise Reduction (ANR) audio system, comprising:

a first wearable audio device comprising:

a first sensor arranged to determine if the first wearable audio device is engaged with or removed from a first ear of a user;

a second wearable audio device comprising:

a second sensor arranged to determine if the second wearable audio device is engaged with or removed from a second ear of the user; and a controller arranged to:

set one or more ANR parameters of the first and the second wearable audio device to a first ANR state;

detect that the first wearable audio device is removed from the first ear of the user; and automatically adjust the one or more ANR parameters of the second wearable audio device to a second ANR state when the first wearable audio device is removed from the first ear of the user, wherein the second ANR state comprises a reduction in a level of ANR compared to the first ANR state.

15. The audio system of claim 14, wherein the controller is further arranged to:

detect whether the first wearable audio device is engaged with or removed from the first ear of the user using the first sensor of the first wearable audio device and detecting whether the second wearable audio device is engaged with or removed from the second ear of the user using the second sensor of the second wearable audio device; and automatically adjust the one or more ANR parameters of the first and second wearable audio device to the first ANR state when both the first and second wearable audio device are detected to be engaged with the first and second ears of the user.

16. The audio system of claim 14, wherein the first and second wearable audio device are arranged to operate in a plurality of ANR states during which the one or more ANR parameters are adjusted using a user interface to increase or decrease noise reduction.

17. The audio system of claim 14, wherein the first wearable audio device further comprises a first user interface adapted to receive user input to increase or decrease noise reduction.

18. The audio system of claim 14, wherein the first wearable audio device further comprises a first outer surface, the first outer surface comprising a first touch capacitive sensor.

19. The audio system of claim 14, wherein the controller is arranged within, around, or proximate to the first wearable audio device or the second wearable audio device.

20. The audio system of claim 14, wherein the first sensor of the first wearable audio device and the second sensor of the second wearable audio device comprise at least one of: a gyroscope, an accelerometer, an infrared sensor, a magnetometer, an acoustic sensor, a motion sensor, a piezoelectric sensor, a piezoresistive sensor, a capacitive sensor, and a magnetic field sensor.

* * * * *